US009719354B2

(12) United States Patent
Kitagawa et al.

(10) Patent No.: US 9,719,354 B2
(45) Date of Patent: Aug. 1, 2017

(54) GAS TURBINE WITH IMPROVED BLADE AND VANE AND FLUE GAS DIFFUSER

(75) Inventors: Hitoshi Kitagawa, Tokyo (JP); Yasuro Sakamoto, Tokyo (JP); Eisaku Ito, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 630 days.

(21) Appl. No.: 14/008,513

(22) PCT Filed: Mar. 23, 2012

(86) PCT No.: PCT/JP2012/057592

§ 371 (c)(1),
(2), (4) Date: Oct. 24, 2013

(87) PCT Pub. No.: WO2012/133224

PCT Pub. Date: Oct. 4, 2012

(65) Prior Publication Data

US 2014/0041395 A1 Feb. 13, 2014

(30) Foreign Application Priority Data

Mar. 30, 2011 (JP) ..... 2011-076017

(51) Int. Cl.
*F01D 5/14* (2006.01)

(52) U.S. Cl.
CPC ..... *F01D 5/14* (2013.01); *F01D 5/141* (2013.01); *F01D 5/142* (2013.01); *F01D 5/145* (2013.01)

(58) Field of Classification Search
CPC . F01D 5/14; F01D 5/141; F01D 5/142; F01D 5/143; F01D 5/145; F01D 5/148
See application file for complete search history.

(56) References Cited

U.S. PATENT DOCUMENTS 6,004,095 A * 12/1999 Waitz ..... B64C 21/025 415/115
6,036,438 A 3/2000 Imai
(Continued)

FOREIGN PATENT DOCUMENTS

CN 1186900 A 7/1998
CN 1547642 A 11/2004
(Continued)

OTHER PUBLICATIONS

Machhine translation of IDS ref JP 2003/020904.*
(Continued)

*Primary Examiner* — Arun Goyal
(74) *Attorney, Agent, or Firm* — Westerman, Hattori, Daniels & Adrian, LLP

(57) ABSTRACT

A gas turbine burns the air compressed in a compressor with supplying fuel in a combustor so as to obtain rotary power by supplying the generated combustion gas to a turbine. The turbine includes turbine vane elements and turbine blade elements that are alternately positioned in a direction in which the combustion gas fluidizes in a turbine cylinder having a cylindrical shape, and a flue gas diffuser having a cylindrical shape and connected to a rear portion of the turbine cylinder. The turbine blade element includes a plurality of turbine blades positioned at equal intervals in the circumference direction. The turbine blades have a throat width on a longitudinal end side made larger than a throat width on a longitudinally intermediate portion side. This efficiently restores the pressure of the flue gas. This improves the efficiency of the turbine so that the performance can be improved.

4 Claims, 10 Drawing Sheets

(56) References Cited

U.S. PATENT DOCUMENTS

| | | | | |
|---|---|---|---|---|
| 6,799,948 | B2 * | 10/2004 | Ito | F01D 5/141 416/223 A |
| 7,048,509 | B2 * | 5/2006 | Tominaga | F01D 5/14 416/223 A |
| 8,708,639 | B2 * | 4/2014 | Subramaniyan | F01D 5/143 415/1 |
| 2013/0064638 | A1 * | 3/2013 | Subramaniyan | F01D 11/04 415/1 |

FOREIGN PATENT DOCUMENTS

| | | | |
|---|---|---|---|
| CN | 101960101 | A | 1/2011 |
| EP | 1422382 | A1 | 5/2004 |
| EP | 1 584 786 | A2 | 10/2005 |
| EP | 1 710 395 | A2 | 10/2006 |
| EP | 2 412 922 | A1 | 2/2012 |
| JP | 8-218803 | A | 8/1996 |
| JP | 09-112203 | A | 4/1997 |
| JP | 2000-45704 | A | 2/2000 |
| JP | 2003-020904 | A | 1/2003 |
| JP | 2004-263602 | A | 9/2004 |
| JP | 3773565 | B2 | 5/2006 |
| JP | 2009-203871 | A | 9/2009 |
| JP | 2010-180827 | A | 8/2010 |
| JP | 2011-021525 | A | 2/2011 |
| JP | 2011-038491 | A | 2/2011 |
| WO | 2011/040241 | A1 | 4/2011 |

OTHER PUBLICATIONS

Extended European Search Report dated Jul. 29, 2014, issued in European Patent Application No. 12763068.9 (6 pages).

Chinese Office Action dated Oct. 31, 2014, issued in corresponding CN Patent Application No. 201280016252.2 with English translation (22 pages).

Notification of the Decision to Grant a Patent Right for Patent for Invention dated Jul. 2, 2015, issued in counterpart Chinese Patent Application No. 201280016252.2, with English translation. (4 pages).

Office Action dated Dec. 8, 2015., issued in counterpart Japanese Patent Application No. 2011-076017, with English translation. (3 pages).

English translation of Written Opinion of PCT/JP2012/057592, mailing date of Apr. 17, 2012.

International Search Report of PCT/JP2012/057592, mailing date of Apr. 17, 2012.

Written Opinion of PCT/JP2012/057592, mailing date of Apr. 17, 2012.

* cited by examiner

GAS TURBINE WITH IMPROVED BLADE AND VANE AND FLUE GAS DIFFUSER

FIELD

The present invention relates to a gas turbine that, for example, burns a high temperature and pressure compressed air with supplying fuel to the air so as to obtain rotary power by supplying the generated combustion gas to the turbine.

BACKGROUND

A gas turbine includes a compressor, a combustor and a turbine. The compressor compresses the air from an air inlet so that the air becomes a high temperature and pressure compressed air. The combustor burns the compressed air with supplying fuel. The high temperature and pressure combustion gas drives the turbine and also drives an electricity generator connected to the turbine. In such a case, the turbine includes a plurality of turbine vanes and turbine blades that are alternately provided in a cylinder. Driving the turbine blades with the combustion gas rotates and drives an output shaft to which the electricity generator is connected. The energy of the combustion gas (flue gas) after driving the turbine is gradually converted into pressure with a flue gas diffuser without loss and is released into the air.

The flue gas diffuser is provided at the turbine in the gas turbine having such a configuration so as to extend the flow passage area from the exit of the turbine, namely, the entrance of the diffuser in the direction in which the flue gas fluidizes. The flue gas diffuser decelerates the flue gas after the power is recovered in the turbine and can restore the pressure.

A gas turbine having such a flue gas diffuser is, for example, described in Patent Literature 1.

CITATION LIST

Patent Literature

Patent Literature 1: Japanese Laid-open Patent Publication No. 2009-203871

SUMMARY

Technical Problem

By the way, the amount of restoration of the pressure increased by a deceleration of the flue gas in the flue gas diffuser improves the efficiency of the turbine so that the performance of the gas turbine can be improved. Making the flow passage area at the exit larger than the flow passage area at the entrance facilitates an increase in the amount of restoration of the pressure in the flue gas diffuser. However, when the flow passage area at the exit is drastically larger than the flow passage area at the entrance in the flue gas diffuser, the flow of the flue gas is separated near the wall surface on outer circumference side or near the wall surface on the center side. This reduces the amount of restoration of the pressure. On the other hand, preventing the flow passage area at the exit from being drastically larger than the flow passage area at the entrance in the flue gas diffuser elongates the length in the longitudinal direction of the flue gas diffuser (the direction in which the flue gas fluidizes). This causes an increase in the size of the flue gas diffuser.

To solve the problem, an objective of the present invention is to provide a gas turbine capable of improving the performance with improving the efficiency of the turbine by efficiently restoring the pressure of the flue gas.

Solution to Problem

According to an aspect of the present invention in order to solve the problems, there is provided a gas turbine for burning air compressed in a compressor with supplying fuel in a combustor so as to obtain rotary power by supplying generated combustion gas to a turbine, wherein the turbine turbine vane elements and turbine blade elements that are alternately positioned in a direction in which the combustion gas fluidizes, the turbine vane elements and turbine blade elements being arranged in a turbine cylinder having a cylindrical shape, and a flue gas diffuser having a cylindrical shape and connected to a rear portion of the turbine cylinder, the turbine vane element includes a plurality of turbine vanes positioned at equal intervals in a circumference direction and the turbine blade element includes a plurality of turbine blades fixed at equal intervals in a circumference direction, and the turbine vanes or the turbine blades have a throat width on a longitudinal end side made larger than a throat width on a longitudinally intermediate portion side.

Thus, setting the throat width on an end side of the turbine vanes or the turbine blades larger than the throat width on the intermediate portion side makes the outflow angle on the end side smaller than the outflow angle at the intermediate portion. This appropriately controls the flow of the flue gas flowing in the flue gas diffuser so that the pressure of the flue gas can efficiently be restored. This improves the efficiency of the turbine so that the performance can be improved.

According to another aspect of the present invention, there is provided the gas turbine, wherein the turbine vanes or the turbine blades have throat widths on both longitudinal end sides made larger than a throat width on a longitudinally intermediate portion side.

This can appropriately control the flow of the flue gas flowing from both longitudinal end sides of the turbine vanes or the turbine blades to the flue gas diffuser so that the amount of restoration of the pressure can appropriately be increased therein.

According to still another aspect of the present invention, there is provided the gas turbine, wherein the turbine blades have a throat width on a base end side fixed on a turbine shaft and a throat width on a tip side made larger than a throat width on an intermediate portion side between the base end side and the tip side, and the throat width on a tip side is made larger than the throat width on a base end side.

Thus, setting the throat width on the end side of the turbine blades larger than the throat width on the intermediate portion side makes the outflow angle on the end side smaller than the outflow angle on the intermediate portion side. This decreases the amount of the power obtained from the combustion gas on the end side and increases the amount of the power obtained from the combustion gas on the intermediate portion side. As a result, the total pressure of the combustion gas becomes higher at the exit on the end side of the turbine blades than at the exit on the intermediate portion. Thus, the flue gas is not likely to be separated near the wall surface of the flue gas diffuser. This increases the amount of restoration of the pressure therein. Efficiently restoring the pressure of the flue gas improves the efficiency of the turbine so that the performance can be improved.

According to still another aspect of the present invention, there is provided the gas turbine, wherein the turbine vanes have a throat width on a base end side fixed on the turbine shaft and a throat width on a tip side made larger than a throat width on an intermediate portion side between the base end side and the tip side, and the throat width on the base end side is almost the same as the throat width on the tip side.

Thus, setting the throat width on the end side of the turbine vanes larger than the throat width on the intermediate portion side makes the outflow angle on the end side smaller than the outflow angle on the intermediate portion side. Thus, the inflow angle on the end side of the turbine blades positioned on the lower flow side of the turbine vanes decreases. This makes the turning angle of the combustion gas on the end side of the turbine blades smaller than on the intermediate portion side. Thus, the amount of the power obtained from the combustion gas decreases on the end side and the amount of the power obtained from the combustion gas increases on the intermediate portion side. As a result, the total pressure of the combustion gas becomes higher at the exit on the end side of the turbine blades than at the exit on the intermediate portion side. Thus, the flue gas is not likely to be separated near the wall surface of the flue gas diffuser so that the amount of restoration of the pressure increases therein. Efficiently restoring the pressure of the flue gas improves the efficiency of the turbine so that the performance can be improved.

According to still another aspect of the present invention, there is provided the gas turbine, wherein the turbine blades on a last stage turbine blade element have a throat width on a longitudinal end made larger than a throat width on a longitudinally intermediate portion side.

Thus, setting the total pressure of the flue gas flowing from the last stage turbine blade element to the flue gas diffuser at an appropriate value in a radial direction can increase the amount of restoration of the pressure in the flue gas diffuser.

According to still another aspect of the present invention, there is provided the gas turbine, wherein the turbine vanes on a last stage turbine vane element have a throat width on a longitudinal end made larger than a throat width on a longitudinally intermediate portion side.

Thus, setting the total pressure of the flue gas flowing from the last stage turbine vane element to the flue gas diffuser through the last stage turbine blade element at an appropriate value in a radial direction can increase the amount of restoration of the pressure in the flue gas diffuser.

Advantageous Effects of Invention

The gas turbine of the present invention has a throat width on an end side in the longitudinal direction of the turbine vanes or the turbine blades made larger than the throat width on the longitudinally intermediate portion side. This makes the outflow angle on the end side smaller than the outflow angle at the intermediate portion. This can appropriately control the flow of the flue gas flowing in the flue gas diffuser. Thus, efficiently restoring the pressure of the flue gas improves the efficiency of the turbine so that the performance can be improved.

DESCRIPTION OF EMBODIMENTS

Hereinafter, the preferred embodiments of the gas turbine according to the present invention will be described in detail with reference to the accompanying drawings. Note that the present invention is not limited to the embodiments and includes a combination of the embodiments when there is a plurality of embodiments.

First Embodiment

Figure 1:
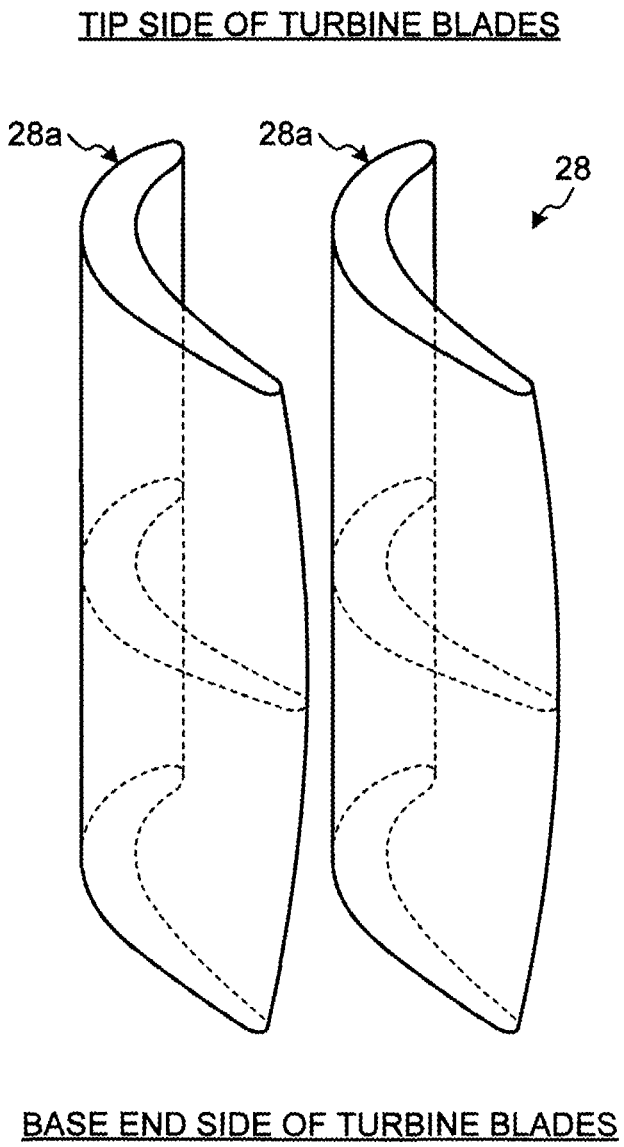
FIG. 1 is a schematic diagram of last stage turbine blades of a turbine in a gas turbine according to a first embodiment of the present invention.
Figure 2:
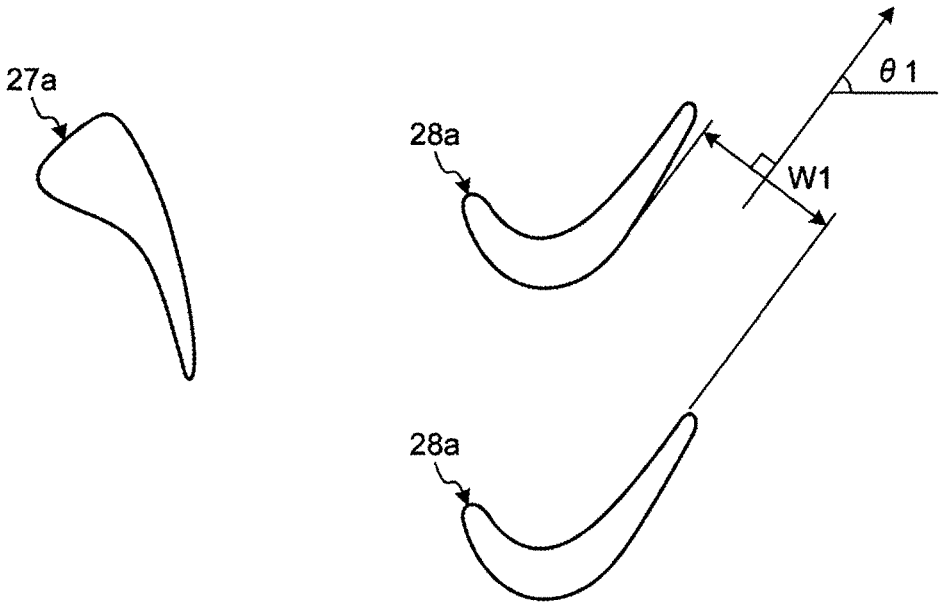
FIG. 2 is a schematic diagram for illustrating a throat width between the tips of the last stage turbine blades of the turbine according to the first embodiment.
Figure 3:
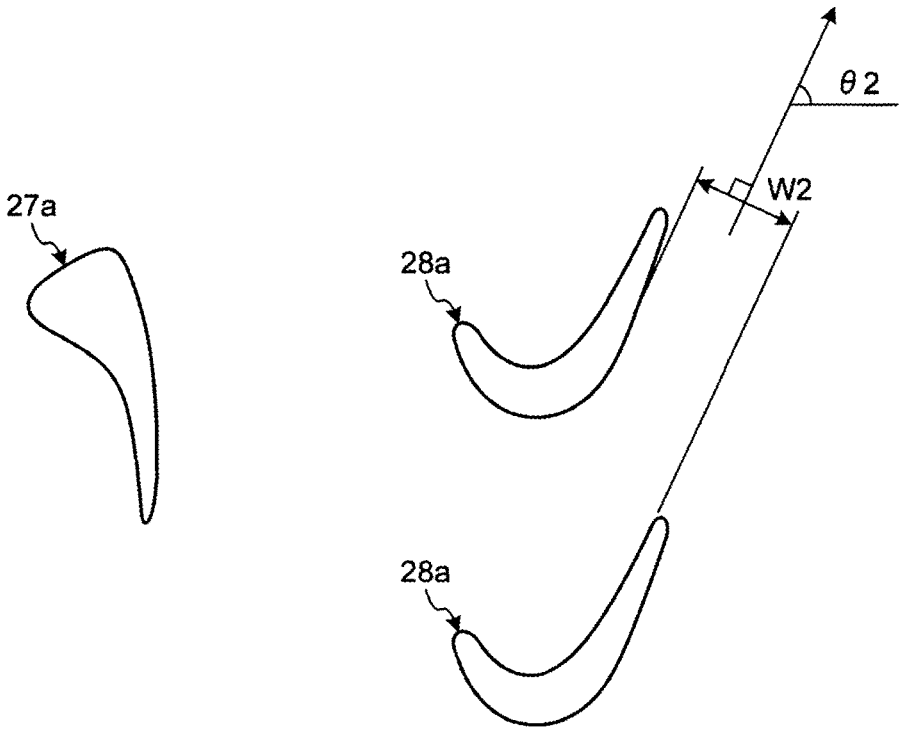
FIG. 3 is a schematic diagram for illustrating a throat width between the intermediate portions of the last stage turbine blades of the turbine according to the first embodiment.
Figure 4:
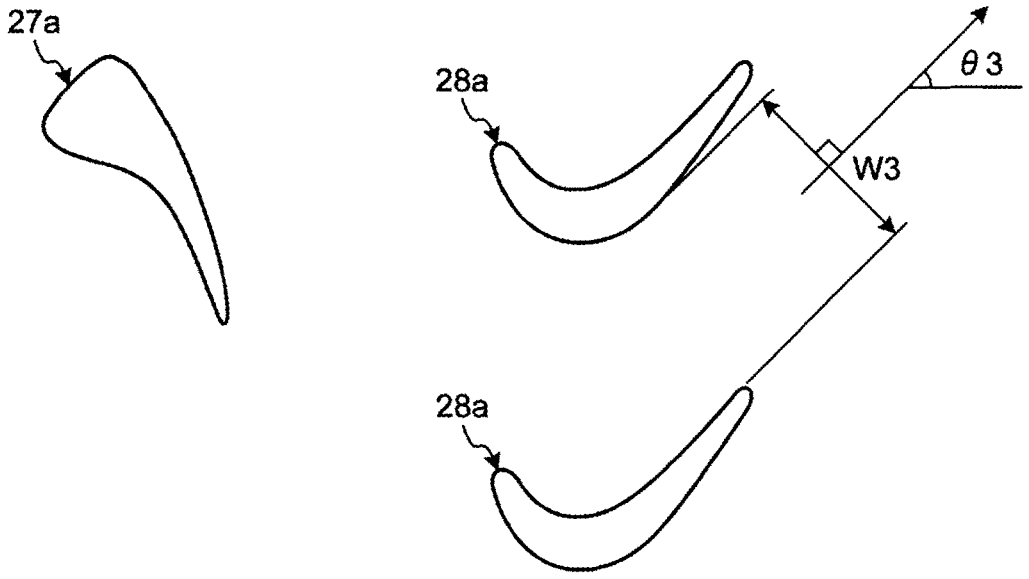
FIG. 4 is a schematic diagram for illustrating a throat width between the base ends of the last stage turbine blades of the turbine according to the first embodiment.
Figure 5:
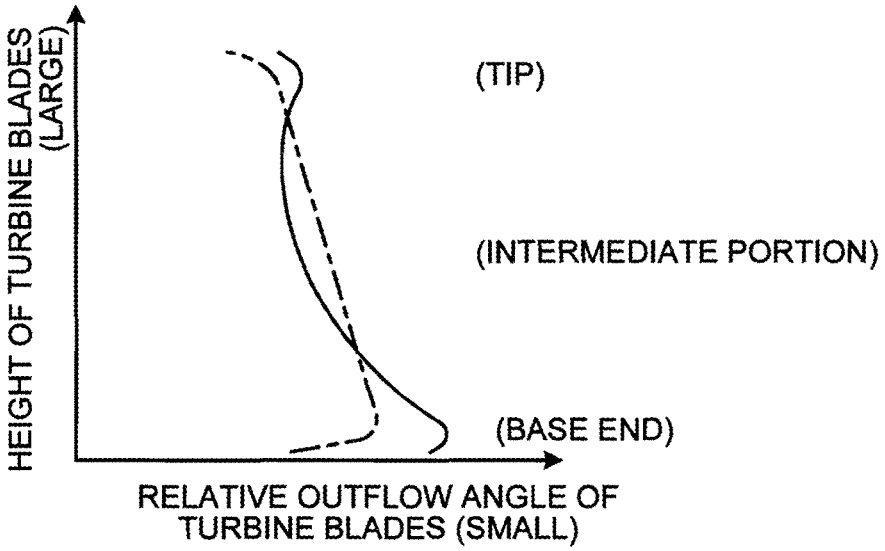
FIG. 5 is a graph indicating the relative outflow angle of the turbine blades in the height direction of the last stage turbine blades.
Figure 6:
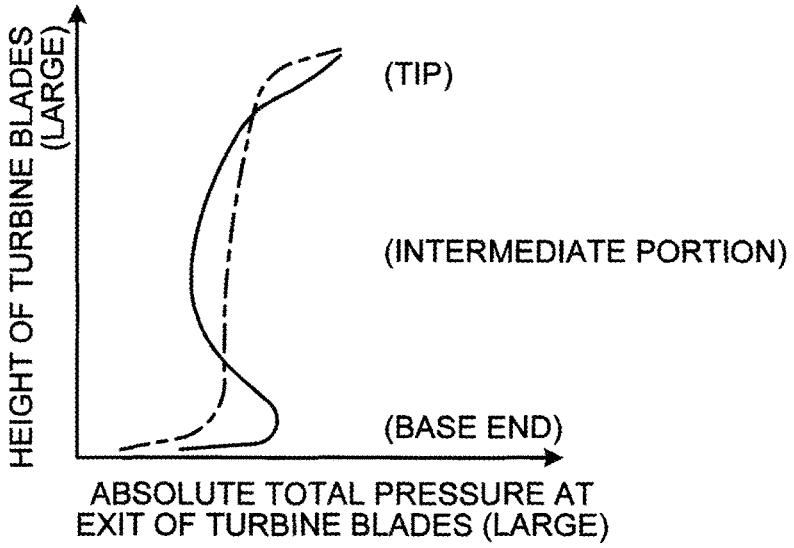
FIG. 6 is a graph indicating the absolute total pressure at the exits of the last stage turbine blades in the height direction of the last stage turbine blades.
Figure 7:
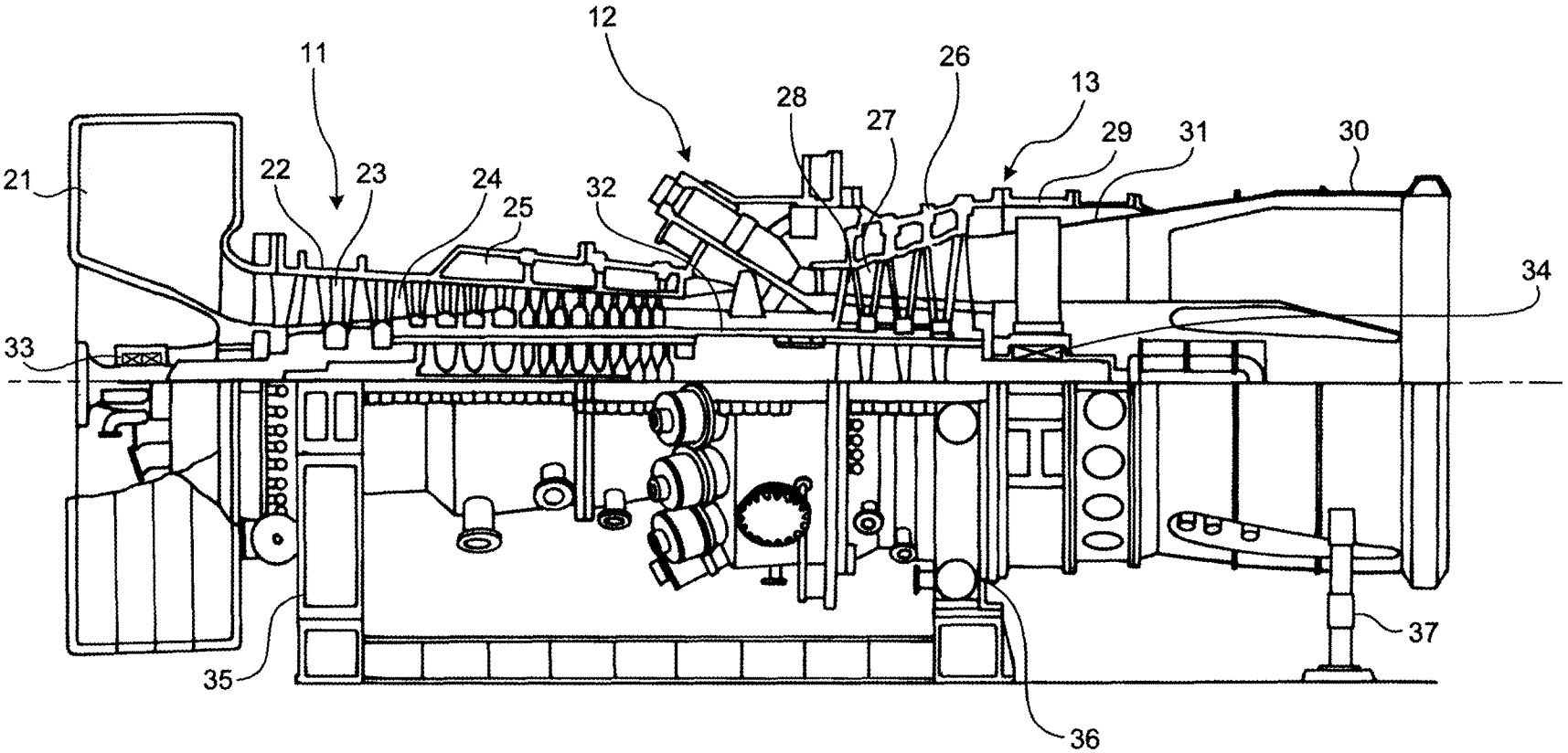
FIG. 7 is a schematic diagram of the gas turbine according to the first embodiment.
Figure 8:
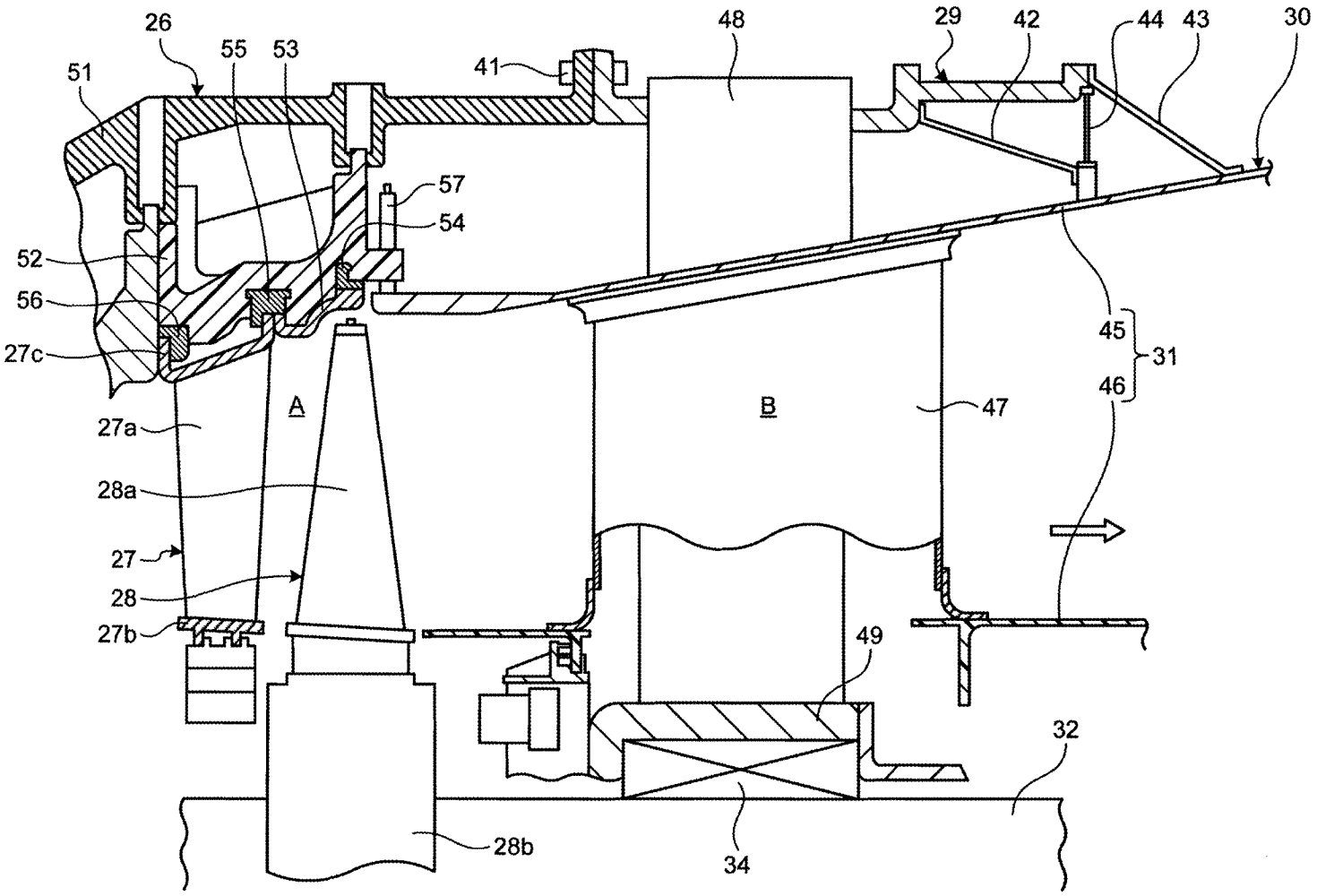
FIG. 8 is a schematic diagram for illustrating the structure from last stage turbine vanes to a flue gas diffuser in the gas turbine according to the first embodiment.

FIG. 1 is a schematic diagram of last stage turbine blades of a turbine in the gas turbine according to a first embodiment of the present invention. FIG. 2 is a schematic diagram for illustrating a throat width between the tips of the last stage turbine blades of the turbine according to the first embodiment. FIG. 3 is a schematic diagram for illustrating a throat width between the intermediate portions of the last stage turbine blades of the turbine according to the first embodiment. FIG. 4 is a schematic diagram for illustrating a throat width between the base ends of the last stage turbine blades of the turbine according to the first embodiment. FIG. 5 is a graph indicating the relative outflow angle of the blades in the height direction of the last stage turbine blades. FIG. 6 is a graph indicating the absolute total pressure at the exits of the last stage turbine blades in the height direction of the last stage turbine blades. FIG. 7 is a schematic diagram of the gas turbine according to the first embodiment. FIG. 8 is a schematic diagram for illustrating the structure from last stage turbine vanes to a flue gas diffuser in the gas turbine according to the first embodiment.

As illustrated in FIG. 7, the gas turbine according to the first embodiment includes a compressor 11, a combustor 12, and a turbine 13. An electricity generator (not illustrated in the drawings) is connected to the gas turbine such that electricity can be generated.

The compressor 11 includes an air inlet 21, a plurality of compressor vane elements 23 and compressor blade elements 24 in a compressor cylinder 22 and a extraction room 25 at the outside of the compressor cylinder 22. The air inlet 21 takes in the air. The compressor vane elements 23 and compressor blade elements 24 are alternately provided in a longitudinal direction (the axial direction of a rotor 32 to be described below). The combustor 12 is capable of burning the air compressed in the compressor 11 by supplying fuel to the compressed air and igniting it. The turbine 13 includes a plurality of turbine vane elements 27 and turbine blade elements 28 that are alternately provided in a turbine cylinder 26 in the longitudinal direction (the axial direction of a rotor 32 to be described below). A flue gas room 30 is provided on the lower stream side of the turbine cylinder 26 trough a flue gas cylinder 29. The flue gas room 30 includes a flue gas diffuser 31 connected to the turbine 13.

A rotor (turbine shaft) 32 is positioned so as to penetrate through the centers of the compressor 11, the combustor 12, the turbine 13, and the flue gas room 30. An end of the rotor 32 that is on the compressor 11 side is rotatably supported with a bearing 33. The other end of the rotor 32 that is on the flue gas room 30 side is rotatably supported with a bearing 34. A plurality of disks that each is equipped with the compressor blade elements 24 and that are arranged in a row is fixed on the rotor 32 in the compressor 11. A plurality of disks that each is equipped with the turbine blade elements 28 and that are arranged in a row is fixed on the rotor 32 in the turbine 13. The driving shaft of the electricity generator (not illustrated in the drawings) is connected to the end of the rotor 32 on the compressor 11 side.

In the gas turbine, the compressor cylinder 22 of the compressor 11 is supported with a leg portion 35. The turbine cylinder 26 of the turbine 13 is supported with a leg portion 36. The flue gas room 30 is supported with a leg portion 37.

Thus, the air taken in from the air inlet 21 of the compressor 11 is compressed with passing through the compressor vane elements 23 and the compressor blade elements 24 so as to become a high temperature and pressure compressed air. The compressed air is supplied with predetermined fuel and is burnt in the combustor 12. The high temperature and pressure combustion gas that is working fluid generated in the combustor 12 drives and rotates the rotor 32 by passing through the turbine vane elements 27 and the turbine blade elements 28 included in the turbine 13 such that the electricity generator connected to the rotor 32 is driven. On the other hand, the energy of the flue gas (combustion gas) is released into the air after being converted into pressure and decelerated with the flue gas diffuser 31 of the flue gas room 30.

In the turbine 13 as illustrated in FIG. 8, the turbine cylinder 26 having a cylindrical shape includes the turbine vane elements 27 and the turbine blade elements 28 that are alternately provided therein along the direction in which the combustion gas fluidizes. The turbine cylinder 26 is provided with the flue gas cylinder 29 having a cylindrical shape on the lower stream side in the direction in which the combustion gas fluidizes. The flue gas cylinder 29 is provided with the flue gas room 30 having a cylindrical shape on the lower stream side in the direction in which the combustion gas fluidizes. The flue gas room 30 is provided with a flue gas duct (not illustrated in the drawings) on the lower stream side in the direction in which the combustion gas fluidizes. In that case, each of the turbine cylinder 26, the flue gas cylinder 29, the flue gas room 30, and the flue gas duct has separately been produced as a top and a bottom and is formed by integrally connecting the top and the bottom to each other.

The turbine cylinder 26 and the flue gas cylinder 29 are connected to each other with a plurality of connecting bolts 41. The flue gas cylinder 29 and the flue gas room 30 are connected to each other with a plurality of flue gas room supports 42 and 43 capable of absorbing thermal expansion. The flue gas room supports 42 and 43 have a rectangular shape and extend along the axial direction of the turbine 13 as being provided at predetermined intervals in the circumferential direction. The deformation of the flue gas room supports 42 and 43 can absorb thermal expansion when the thermal expansion has occurred between the flue gas cylinder 29 and the flue gas room 30 because of the difference of the temperatures. The thermal expansion tends to occur during a period of transition, for example, during the activation of the turbine 13 or during a high-loaded state. A gas seal 44 is provided between the flue gas cylinder 29 and the flue gas room 30 as being positioned between each of the flue gas room supports 42 and 43.

The flue gas diffuser 31 that includes the flue gas room 30 therein and has a cylindrical shape is positioned in flue gas cylinder 29. The flue gas diffuser 31 includes an external diffuser 45 and an internal diffuser 46 that are formed into a cylindrical shape with being connected to each other with a plurality of strut shields 47. The strut shields 47 have a hollow structure, for example, a cylindrical shape or an elliptically cylindrical shape and are provided at equal intervals in the circumferential direction of the flue gas diffuser 31. Note that the flue gas room supports 42 and 43, and the gas seal 44 are connected to the external diffuser 45 of the flue gas diffuser 31 of which end is formed into the flue gas room 30.

A strut 48 is provided in the strut shield 47. An end of the strut 48 penetrates through the internal diffuser 46 and is connected to a bearing box 49 housing the bearing 34 such that the rotor 32 is rotatably supported by the bearing 34. The other end of the strut 48 penetrates through the external diffuser 45 and is fixed at the flue gas cylinder 29. Note that the space in the strut shield 47 is communicated with the space in the flue gas diffuser 31 (the internal diffuser 46) and the space between the flue gas cylinder 29 and the flue gas diffuser 31 (the external diffuser 45) so that cooling air can be supplied into the spaces from the outside.

The turbine vane elements 27 and the turbine blade elements 28 are alternately provided in the turbine cylinder 26 and have almost the same blade ring structures and vane ring structure at the stages. In that case, each of the turbine vane elements 27 includes a plurality of turbine vanes 27*a* positioned in equal intervals in the circumferential direction. An internal shroud 27*b* is fixed at the base end on the rotor 32 side and an external shroud 27*c* is fixed at the tip on the turbine cylinder 26 side. Similarly, each of the turbine blade elements 28 includes turbine blades 28*a* positioned in equal intervals in the circumferential direction. The base end of each turbine blade 28*a* is fixed at a rotor disk 28*b* fixed at the rotor 32 and the tip extends toward the turbine cylinder 26 side. Last stage turbine blades 28*a* are positioned on the lower stream side of last stage turbine vanes 27*a*.

In that case, a last stage vane ring structure in the turbine cylinder 26 includes a turbine cylinder body 51 having a cylindrical shape, a vane ring 52 provided in the turbine cylinder body 51 and having a cylindrical shape, a split ring 53 positioned laterally to the last stage turbine blades 28*a* and having a cylindrical shape, and heat barrier rings 54, 55, and 56 connecting the split ring 53, the vane ring 52, and the external shroud 27*c* of the last stage turbine vane 27*a*.

The blade ring structure and the vane ring structure are formed at each stage in the turbine 13 as described above. Thus, the internal shroud 27*c*, the split ring 53, and the like included in the turbine cylinder 26 are formed into a combustion gas passage A. The front portion of the flue gas diffuser 31 enters the rear insides of the turbine cylinder 26 and the flue gas cylinder 29 as leaving a predetermined clearance in the radial direction and is connected to a seal device 57 so as to be formed into a flue gas passage B. The combustion gas passage A and the flue gas passage B are coupled to each other.

In the turbine 13 of the first embodiment having such a structure, the turbine blades (last stage turbine blades) 28*a* have a large throat width at a longitudinal end than a throat width at the longitudinally intermediate portion as illustrated in FIG. 1. In the first embodiment, the throat widths of both longitudinal ends of the turbine blades 28 are made larger than the throat width at the longitudinally intermediate portion. In that case, the throat widths of the turbine blades 28*a* are set such that the throat width on the base end side fixed at the rotor 32 and the throat width on the tip side are larger than the throat width on the intermediate portion side between the base end side and the tip side, and the throat width on the tip side is made larger than the throat width on the base end side.

Specifically, FIG. 2 illustrates the cross-sectional shape on the tip side (the turbine cylinder 26 and the split ring 53 side) of the turbine blades 28*a*. Setting a throat with w1 between the adjacent turbine blades 28*a* sets an outflow angle (gauging angle) θ1. FIG. 3 illustrates the cross-sectional shape on the longitudinally intermediate portion side of the turbine blades 28*a*. Setting a throat with w2 between the adjacent turbine blades 28*a* sets an outflow angle (gauging angle) θ2. Further, FIG. 4 illustrates the cross-sectional shape on the base end side (the rotor 32 and the rotor disk 28*b* side) of the turbine blades 28*a*. Setting a throat width w3 between the adjacent turbine blades 28*a* sets an outflow angle (gauging angle) θ3.

The throat widths w1 and w3 on the tip side and on the base end side of the turbine blades 28*a* are larger than the throat with w2 on the intermediate portion side. The throat with w3 on the base end side is larger than the throat with w1 on the tip side.

Note that the throat is a minimum area portion between the back surface and the front surface of the turbine blades 28*a* that are adjacent to each other in a circumferential direction on the lower stream side in the direction in which the combustion gas fluidizes. The throat widths w are widths of the throat portions. Further, an outflow direction is perpendicular to the width direction of the throat portion. The outflow angles θ are angles of the outflow directions to the axial core direction of the rotor 32.

Thus, as illustrated in FIG. 5, conventional turbine blades are designed such that the outflow angle becomes gradually smaller from the tip side to the base end side of the turbine blades as denoted with an alternate long and short dash line. On the other hand, the turbine blades 28*a* of the first embodiment are designed such that the outflow angle becomes gradually larger from the tip side of the turbine blades 28*a* to the intermediate portion and then becomes gradually smaller toward the base end side as denoted with a solid line.

Thus, the turbine blades 28*a* have small outflow angles on the tip side and on the base end side, in other word, have large throat widths on both of the sides so that the amount of the power obtained from the combustion gas decreases. On the other hand, the turbine blades 28*a* have a large outflow angle on the intermediate portion side, namely, have a small throat width so that the amount of the power obtained from the combustion gas increases. Thus, as illustrated in FIG. 6, the total pressure of the combustion gas (flue gas) conventionally stays constant at the turbine blade exit from the tip side to the base end side of the turbine blades, namely, at the entrance of the flue gas diffuser as represented with the alternate long and short dash line so that the flue gas tends to be separated near the wall surfaces of the external diffuser and the internal diffuser. This causes the amount of restoration of the pressure at the flue gas diffuser to be small. On the other hand, the total pressure of the combustion gas (flue gas) becomes higher at the exit of the turbine blades 28*a*, namely, the entrance of the flue gas diffuser 31 on the tip side and the base end side of the turbine blades 28*a* than on the intermediate portion in the first embodiment as represented with the solid line so that the flue gas is not likely to be separated near the wall surfaces of the external diffuser 45 and the internal diffuser 46. This causes the amount of restoration of the pressure at the flue gas diffuser 31 to be large.

As described above, the gas turbine in the first embodiment is configured to burn the air compressed in the compressor 11 with supplying fuel in the combustor 12 so as to obtain rotary power by supplying the generated combustion gas to the turbine 13. The turbine vane elements 27 and the turbine blade elements 28 are alternately positioned in the cylindrical turbine cylinder 26 in the direction in which the combustion gas fluidizes. The cylindrical flue gas diffuser 31 is connected to the rear portion of the turbine cylinder 26 so as to be formed into the turbine 13. The turbine blades 28*a* are positioned at equal intervals in the circumferential direction so as to be formed into the turbine blade elements 28. The turbine blades 28*a* have a throat width on a longitudinal end side made larger than the throat width on the longitudinally intermediate portion side.

Thus, setting the throat width on the end side of the turbine blades 28*a* larger than the throat width on the intermediate portion side makes the outflow angle on the end side smaller than the outflow angle on the intermediate portion side. This decreases the amount of the power obtained from the combustion gas on the end side and increases the amount of the power obtained from the combustion gas on the intermediate portion side. As a result, the total pressure of the combustion gas becomes higher at the exit on the end side of the turbine blades 28*a* than at the exit on the intermediate portion. Thus, the flue gas is not likely to be separated near the wall surface of the flue gas diffuser 31 so that the amount of restoration of the pressure is increased therein. The efficient restoration of the pressure of the flue gas improves the efficiency of the turbine. This can improve the performance.

In the gas turbine in the first embodiment, the throat widths on both longitudinal end sides of the turbine blades 28*a* are larger than the throat width on the longitudinally intermediate portion side. Thus, the flow of the flue gas from both longitudinal end sides of the turbine blades 28*a* to the flue gas diffuser 31 can appropriately be controlled so that the amount of restoration of the pressure can appropriately be increased therein.

In the gas turbine in the first embodiment, the throat width on an end side of the turbine blades 28*a* on the last stage turbine blade element 28 are made larger than the throat width on the longitudinally intermediate portion side. Thus, the total pressure of the flue gas flowing from the last stage turbine blade element 28 to the flue gas diffuser 31 can be set at an appropriate value in the radial direction. This can increase the amount of restoration of the pressure in the flue gas diffuser 31.

Note that, although both of the throat widths on the longitudinal tip side and base end side of the turbine blades 28*a* are made larger than the throat width on the intermediate portion side in the first embodiment, only the throat width on the longitudinal tip side of the turbine blades 28*a* or the throat width on the base end side can be made larger than the throat width on the intermediate portion side.

Second Embodiment

Figure 9:
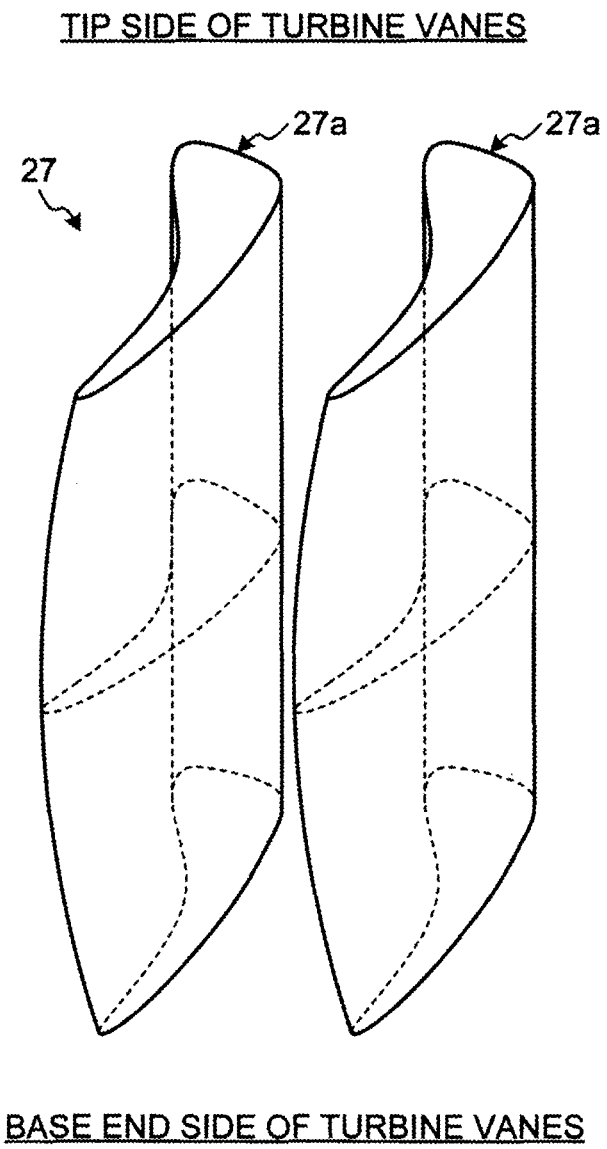
FIG. 9 is a schematic diagram of last stage turbine vanes of a turbine in a gas turbine according to a second embodiment of the present invention.
Figure 10:
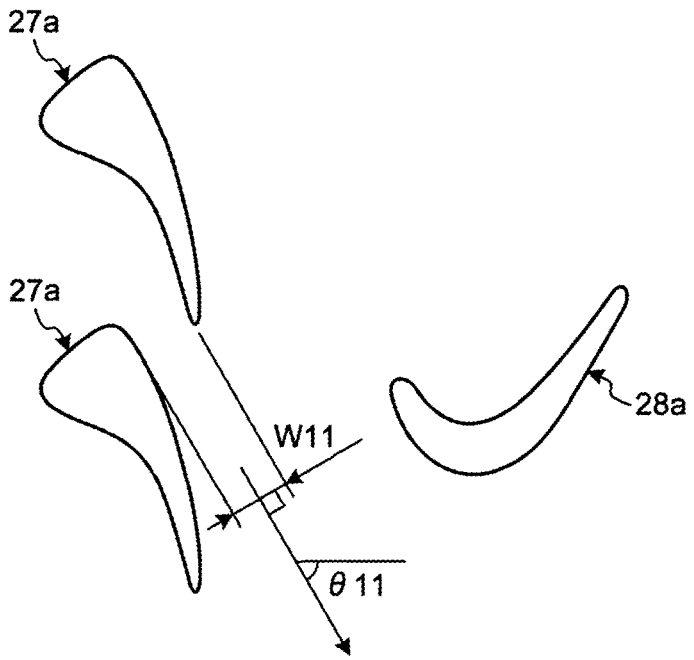
FIG. 10 is a schematic diagram for illustrating a throat width between the tips of the last stage turbine vanes of the turbine according to the second embodiment.
Figure 11:
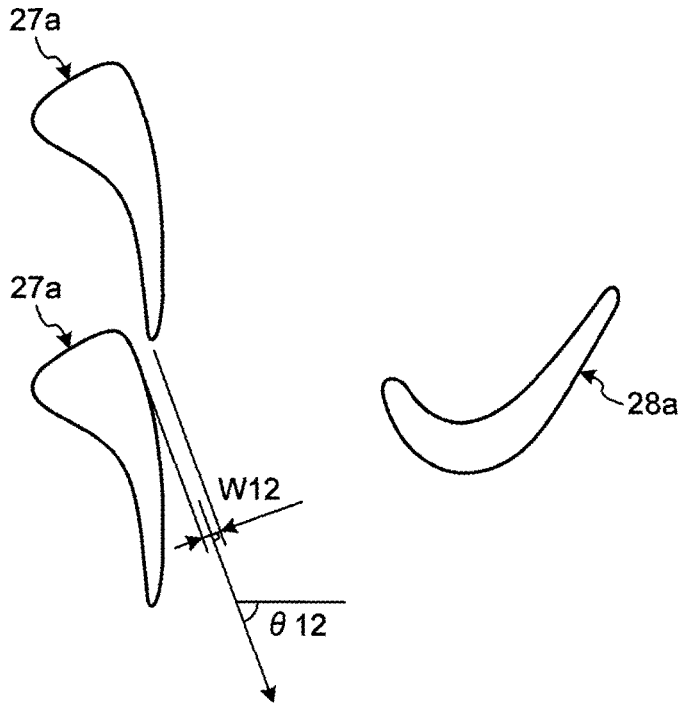
FIG. 11 is a schematic diagram for illustrating a throat width between the intermediate portions of the last stage turbine vanes of the turbine according to the second embodiment.
Figure 12:
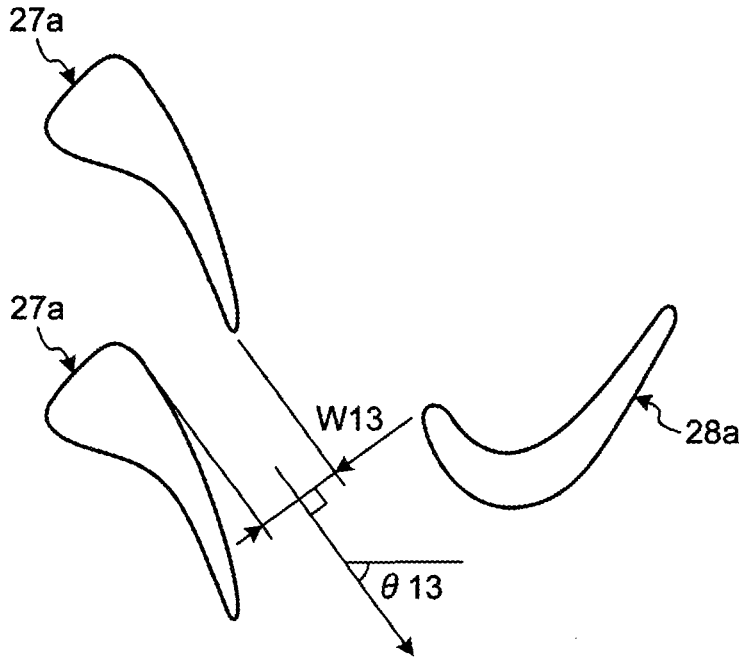
FIG. 12 is a schematic diagram for illustrating a throat width between the base ends of the last stage turbine vanes of the turbine according to the second embodiment.
Figure 13:
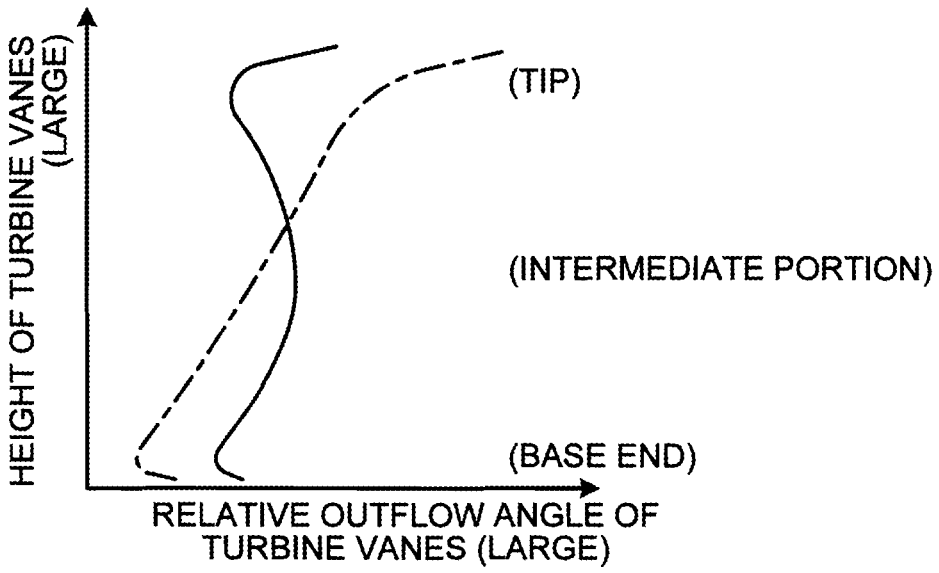
FIG. 13 is a graph indicating the relative outflow angle of the turbine vanes in the height direction of the last stage turbine blades.

FIG. 9 is a schematic diagram of last stage turbine vanes of a turbine in a gas turbine according to a second embodiment of the present invention. FIG. 10 is a schematic diagram for illustrating a throat width between the tips of the last stage turbine vanes of the turbine according to the second embodiment. FIG. 11 is a schematic diagram for illustrating a throat width between the intermediate portions of the last stage turbine vanes of the turbine according to the second embodiment. FIG. 12 is a schematic diagram for illustrating a throat width between the base ends of the last stage turbine vanes of the turbine according to the second embodiment. FIG. 13 is a graph indicating the relative outflow angle of the vanes in the height direction of the last stage turbine vanes.

In the turbine of the gas turbine in the second embodiment, the turbine vanes (last stage turbine vanes) 27*a* have a throat width on a longitudinal end side made larger than the throat width on the longitudinally intermediate portion side as illustrated in FIG. 9. In the second embodiment, the turbine vanes 27*a* have larger throat widths on both longitudinal end sides than the throat width on the longitudinally intermediate portion side. In that case, the turbine vanes 27*a* are designed such that the throat width on the base end side fixed at the internal shroud 27*b* and the throat width on the tip side fixed at the external shroud 27*c* are made larger than the throat on the intermediate portion side between the base end side and the tip side. Further, the throat width on the tip side is set at almost the same as the throat width on the base end side.

Specifically, FIG. 10 illustrates the cross-sectional shape on the tip side (the external shroud 27*c* side) of the turbine vanes 27*a*. Setting a throat width w11 between the adjacent turbine vanes 27*a* sets an outflow angle (gauging angle) θ11. FIG. 11 illustrates the cross-sectional shape on the longitudinally intermediate portion side of the turbine vanes 27*a*. Setting a throat width w12 between the adjacent turbine vanes 27*a* sets an outflow angle (gauging angle) θ12. FIG. 12 illustrates the cross-sectional shape on the base end side (the internal shroud 27*b* side) of the turbine vanes 27*a*. Setting a throat width w13 between the adjacent turbine vanes 27*a* sets an outflow angle (gauging angle) θ13.

The throat widths w11 and w13 on the tip side and on the base end side of the turbine vanes 27*a* are larger than the throat width w12 on the intermediate portion side. The throat width w11 on the tip side has almost the same size as the throat width w13 on the base end side.

Note that the throat is a minimum area portion between the back surface and the front surface of the turbine vanes 27*a* that are adjacent to each other in the circumferential direction on the lower stream side in the direction in which the combustion gas fluidizes. The throat widths w are widths of the throat portions. Further, an outflow direction is perpendicular to the width direction of the throat portion. The outflow angles θ are angles of the outflow directions to the axial core direction of the rotor 32.

Thus, as illustrated in FIG. 13, conventional turbine vanes are designed such that the outflow angle becomes gradually smaller from the tip side to the base end side of the turbine vanes as denoted with an alternate long and short dash line. On the other hand, the turbine vanes 27*a* of the second embodiment are designed such that the outflow angle becomes gradually larger from the tip side to the intermediate portion and then becomes gradually smaller toward the base end side of the turbine vanes 27*a* as denoted with a solid line.

Thus, the turbine vanes 27*a* have small outflow angles on the tip side and on the base end side and thus the inflow angles on the tip side and on the base end side of the turbine blades 28*a* positioned on the lower stream become small. This reduces the turning angles on the tip side and on the base end side of the turbine blades 28*a*. Thus, the amount of the power obtained from the combustion gas decreases. On the other hand, the turbine vanes 27*a* have a large outflow angle on the intermediate portion side and thus the inflow angle on the intermediate portion side of the turbine blades 28*a* positioned on the lower stream become large. This increases the turning angle on the intermediate portion side of the turbine blades 28*a*. Thus, the amount of the power obtained from the combustion gas increases. Thus, the total pressure of the combustion gas (flue gas) conventionally stays constant at the turbine blade exit from the tip side to the base end side of the turbine blades, namely, the entrance of the flue gas diffuser as represented with the alternate long and short dash line illustrated in FIG. 6 described in the first embodiment so that the flue gas tends to be separated near the wall surfaces of the external diffuser and the internal diffuser. This causes the amount of restoration of the pressure at the flue gas diffuser to be small. On the other hand, the total pressure of the combustion gas (flue gas) becomes higher at the exit of the turbine blades 28*a*, namely, the entrance of the flue gas diffuser 31 on the tip side and the base end side of the turbine blades 28*a* than on the intermediate portion in the second embodiment as represented with the solid line in FIG. 6 so that the flue gas is not likely to be separated near the wall surfaces of the external diffuser 45 and the internal diffuser 46. This causes the amount of restoration of the pressure at the flue gas diffuser 31 to be large.

In the gas turbine in the second embodiment as described above, the turbine vanes 27*a* are positioned at equal intervals in the circumferential direction so as to be formed into the turbine vane element 27. The throat width on the base end side positioned on the rotor 32 side of the turbine vanes 27*a* and the throat width on the tip side are made larger than the throat width on the intermediate portion side between the base end side and the tip side. The throat width on the base end side has almost the same size as the throat width on the tip side.

Thus, setting the throat width on an end side of the turbine vanes 27*a* larger than the throat width on the intermediate portion side makes the outflow angle on the end side smaller than the outflow angle on the intermediate portion side. The inflow angle and the turning angle on the end side of the turbine blades 28*a* positioned on the lower flow side decrease. Thus, the amount of the power obtained from the combustion gas decreases on the end side and the amount of the power obtained from the combustion gas increases on the intermediate portion side. As a result, the total pressure of the combustion gas becomes higher at the exit on the end side of the turbine blades 28*a* than at the exit on the intermediate portion side. Thus, the flue gas is not likely to be separated near the wall surface of the flue gas diffuser 31 so that the amount of restoration of the pressure increases therein. The efficient restoration of the pressure of the flue gas improves the efficiency of the turbine. This can improve the performance.

In the gas turbine in the second embodiment, the throat width on the longitudinal end side of the turbine vanes 27*a* on the last stage turbine vane element 27 are made larger than the throat width on the longitudinally intermediate portion side. Thus, the total pressure of the flue gas flowing from the last stage turbine vane element 27 to the flue gas diffuser 31 through the last stage turbine blade element 28 can be set at an appropriate value in the radial direction. This can increase the amount of restoration of the pressure in the flue gas diffuser 31.

Note that, although both of the throat widths on the longitudinal tip side and base end side of the turbine vanes 27*a* are made larger than the throat width on the intermediate portion side in the second embodiment, only the throat width on the longitudinal tip side of the turbine vanes 27*a* or the throat width on the base end side can be made larger than the throat width on the intermediate portion side.

Applying a turbine employing both of the shapes of the turbine blades 28*a* on the turbine blade elements 28 in the first embodiment and the shapes of the turbine vanes 27*a* on the turbine vane elements 27 in the second embodiment can further improve the efficiency of the turbine and thus improve the performance.

REFERENCE SIGNS LIST

11 Compressor
12 Combustor
13 Turbine
26 Turbine cylinder
27 Turbine vane element
27*a* Last stage turbine vane
27*b* Internal shroud
27*c* External shroud
28 Turbine blade element
28*a* Last stage turbine blade
28*b* Rotor disk
29 Flue gas cylinder
30 Flue gas room
31 Flue gas diffuser
32 Rotor (Turbine shaft)
45 External diffuser
46 Internal diffuser
48 Strut
51 Turbine cylinder body
52 Vane ring
53 Split ring
54, 55, 56 Heat barrier ring
A Combustion gas passage
B Flue gas passage

The invention claimed is:

1. A gas turbine comprising:

a compressor for compressing air;

a combustor for burning the compressed air with fuel; and a turbine to which generated combustion gas is supplied, wherein the turbine includes turbine vane elements and turbine blade elements that are alternately positioned in a direction in which the combustion gas fluidizes, the turbine vane elements and turbine blade elements being arranged in a turbine cylinder having a cylindrical shape, and an axial flow flue gas diffuser having a cylindrical shape and connected to a rear portion of the turbine cylinder after a last stage of the turbine vane elements or the turbine blade elements, wherein the turbine vane elements include a plurality of turbine vanes positioned at equal intervals in a circumference direction of the turbine cylinder and the turbine blade elements include a plurality of turbine blades fixed at equal intervals in the circumference direction, wherein the turbine vanes extend from a vane base end side to a vane tip end with a vane tip side radially inward of the vane tip end in a radial direction in the turbine cylinder, the turbine vanes at the last stage of the turbine vane elements having a throat width at the vane base end side and at the vane tip side larger than a throat width at a center portion of the turbine vanes, or the turbine blades extend from a blade base end side to a blade tip end with a blade tip side radially inward of the blade tip end in the radial direction in the turbine cylinder, the turbine blades at the last stage of the turbine blade elements having a throat width at the blade base end side and at the blade tip side larger than a throat width at a center portion of the turbine blades, wherein the axial flow flue gas diffuser having a shape configured to restore pressure maintaining an increased total pressure of flue gas exiting the last stage of the turbine vane elements or the turbine blade elements at their respective the tip side and the base end side, wherein the vane tip side is between the center portion of the turbine vanes and the vane tip end, and the vane tip side corresponds to an area close to the vane tip end rather than the center portion of the turbine vanes, wherein the blade tip side is between the center portion of the turbine blades and the blade tip end, and the blade tip side corresponds to an area close to the blade tip end rather than the center portion of the turbine blades, wherein the respective heights of the turbine vane elements and the turbine blade elements increase toward the axial flow flue diffuser, and wherein each of the turbine vanes at the last stage of the turbine vane elements and the turbine blades at the last stage of the turbine blade elements has a maximum height.

2. The gas turbine according to claim 1, wherein the turbine blades of the last stage have the throat width at the blade base end side fixed on a turbine shaft, and the throat width at the blade tip side is made larger than the throat width at the blade base end side.

3. The gas turbine according to claim 1, wherein the turbine vanes of the last stage have the throat width at the vane base end side substantially the same as the throat width on the vane tip side.

4. The gas turbine according to claim 1, wherein the turbine vanes and the turbine blades of the last stage both have the throat width at their respective the base end side and the tip side larger than the throat width at their respective the center portion.

* * * * *